United States Patent [19]

Miles

[11] 4,072,076

[45] Feb. 7, 1978

[54] PUNCHING APPARATUS

[75] Inventor: Geoffrey Robert Henry Miles, Kettering, England

[73] Assignee: Timsons Limited, Kettering, England

[21] Appl. No.: 740,545

[22] Filed: Nov. 10, 1976

[30] Foreign Application Priority Data

Nov. 11, 1975 United Kingdom ..... 46458/75

[51] Int. Cl.[2] ..... B26D 1/56

[52] U.S. Cl. ..... 83/300; 83/345; 83/595; 83/671; 83/692; 83/917

[58] Field of Search ..... 83/343, 345, 332, 917, 83/300, 595, 685, 692, 693, 695, 671

[56] References Cited

U.S. PATENT DOCUMENTS

| | | | |
|---|---|---|---|
| 1,433,138 | 10/1922 | Kruse | 83/345 X |
| 1,841,296 | 1/1932 | Overbury | 83/332 X |
| 3,067,643 | 12/1962 | Ward, Jr. | 83/332 |
| 3,143,022 | 8/1964 | Andersen | 83/345 X |

*Primary Examiner*—Willie G. Abercrombie
*Attorney, Agent, or Firm*—Darby & Darby

[57] ABSTRACT

Apparatus for punching out a plurality of notches of successively different lengths in an edge portion of a travelling web formed by a pair of rotatable wheels between which the web travels. A plurality of cutting elements, each formed by a bridge-type member having a pair of limbs, are located on one of the wheels with the space between the pair of limbs of each bridge-shaped member being different. The other wheel carries a plurality of cutting punches, each of a size and arranged to fit between the pair of limbs of a bridge-shaped cutting element on the other wheel to provide a shearing action upon engagement with the limbs of a said cutting element.

6 Claims, 1 Drawing Figure

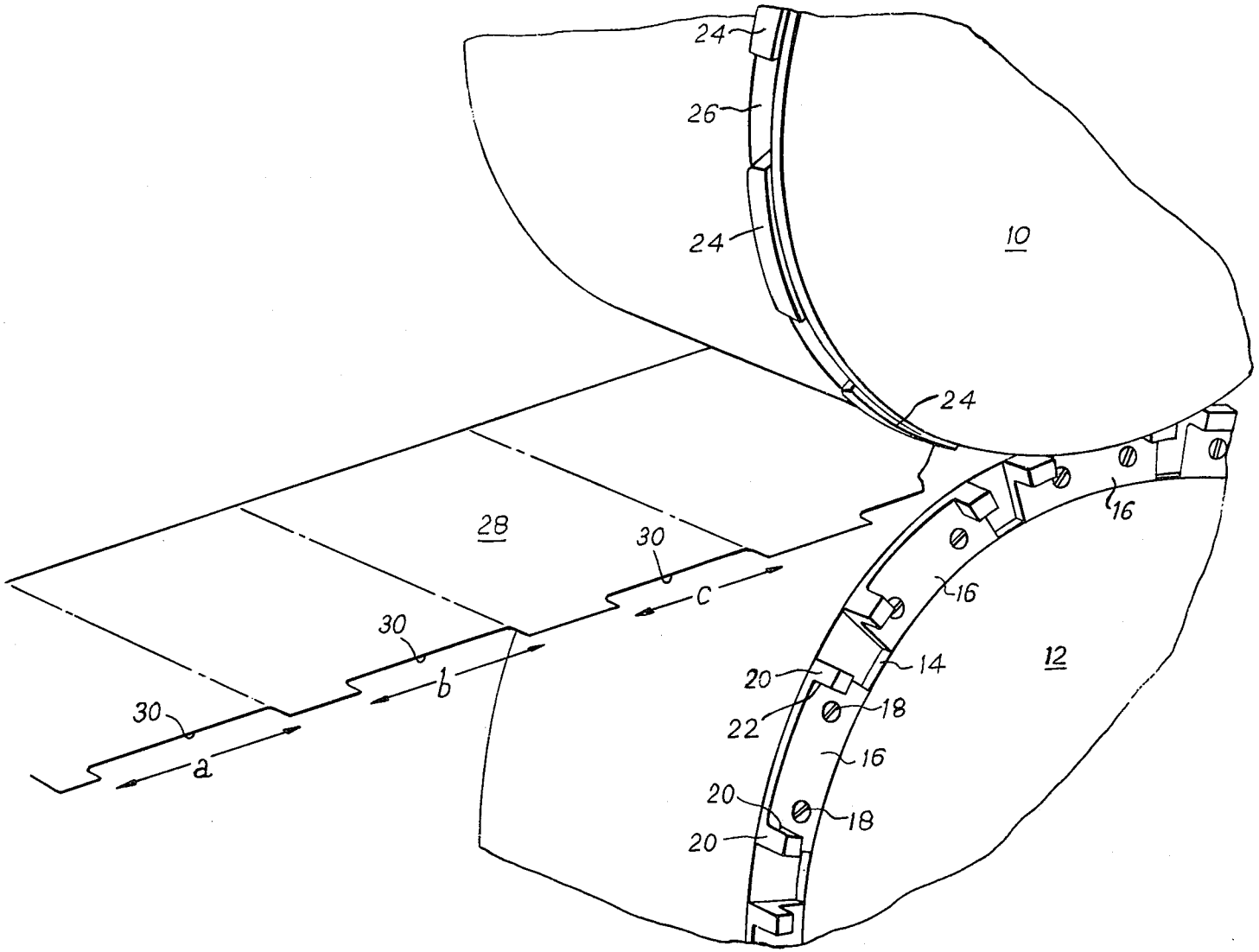
10
12
14
16
18
20
22
24
26
28
30
a
b
c

PUNCHING APPARATUS

The present invention relates to an apparatus for punching out a plurality of notches in an edge portion of a travelling web or stack of webs of paper, board or the like, which notches are to form a step index in a book or booklet into which the web is to be made.

A book or booklet having a step index consists of a plurality of notches cut symmetrically on the fore-edge of a book, the paper leaf of each step carrying marking denoting what the subsequent leaves in that section refer to.

Hitherto, when books or booklets having a step index were produced, a plurality of separate tools have been used at separate punching stations to punch out the different lengths of notches which are necessary for each index. Clearly the length of the apparatus required to produce the notches is long because of the use of a plurality of spaced stations. The invention seeks to avoid this disadvantage.

In accordance with the present invention, therefore, there is provided an apparatus for punching out a plurality of notches in an edge portion of a travelling web or stack of webs, said apparatus comprising a pair of rotatable wheels between which a web or a stack of webs of paper, board or the like is caused to pass, the wheels having a plurality of co-operating cutting elements and blades arranged respectively in spaced relationship around the peripheries of said wheels, which, in use, punch out a plurality of spaced notches from at least one edge of said web or stack of webs during the passage thereof between said wheels, the length of adjacent notches being of a different extent. Where the cutting blades and elements are provided upon one edge of the wheels, only a single row of notches is provided in the web or stack of webs. Alternatively, co-operating cutting elements and blades may be provided on both edges of the wheels in which case two rows of notches are provided. In the latter event the notched web or stack of webs may be longitudinally slit to provide two single width leaves each with a single row of notches.

The cutting elements may take the form of generally bridge-shaped members secured by screws to a recessed flange upon a lateral edge of one of the wheels, for example the lower wheel. Each element may be in the form of a segment having a radius matched to that of the wheel to which it is fitted. The limbs of each bridge-shaped element may form teeth with which the blades on the second wheel co-operate to punch out said notches.

The other wheel includes a plurality of cutter blades or punches which co-operate with the cutting elements as the wheels are rotated and which engage between the limbs of the bridge-shaped elements with a scissor-like action to thereby punch out a notch in the travelling web or stack of webs. The arcuate extent of the teeth and of the co-operating cutting elements differs around the peripheries of the two wheels to thereby produce notches of different lengths. It will be seen that, since notching is performed at a single station, a considerable saving in the length of the apparatus required for notching may be achieved.

The invention will now be described further by way of example with reference to the accompanying drawing the single FIGURE of which shows a partly broken-away, perspective view of an apparatus in accordance with the invention.

In the drawing two-co-operating wheels are designated 10 and 12. An edge of the wheel 12 is recessed at 14 and a plurality of spaced cutting elements 16 are removably mounted in the recess. Each element 16 is segmental and includes a substantially bridge-shaped portion the arms 20 of which define cutting teeth 22 with which a respective cutter blade or punch 24 mounted in an annular groove 26 on the wheel 10 co-operates.

It will be seen that as a web or a stack of webs of paper, board or the like 28 is passed between the wheels 10 and 12 notches 30 are punched out from an edge thereof by a scissor-like cutting action between the elements 16 and the blade or punches 24. The notches punched out are of different lengths to enable the web or webs to be assembled into a book or booklet downstream of the apparatus shown.

For the sake of illustration the individual pages of a booklet are shown in dotted lines to make it clearer that the notches 30 are of successively decreasing lengths, shown as *a, b* and *c*.

It will be appreciated that, because the apparatus used for punching out notches is now restricted in length substantially to the diameter of the two wheels 10 and 12, the overall length of the punching apparatus is considerably reduced.

We claim:

1. An apparatus for punching out a plurality of notches of predetermined length in an edge portion of at least one travelling web, said apparatus comprising:

a. a pair of rotatable wheels between which said at least one web passes, b. a plurality of segmental cutting elements arranged in spaced relationship around the periphery of one of the wheels, each cutting element being a bridge-shaped member with a pair of limbs, the space between the pair of limbs of each bridge-shaped member of each of said cutting elements being of successively respectively decreasing lengths, and c. a plurality of cutting punches arranged in spaced relationship around the periphery of the other wheel, each of the cutting punches being of a size and arranged to fit within the space between a pair of limbs of a respective bridge-shaped member to engage its limbs and to produce a scissor-like action so as, in use, to punch out notches from said at least one web between the wheels.

2. Apparatus as claimed in claim 1, wherein the cutting punches and cutting elements are provided on only one edge of each of the wheels.

3. Apparatus as claimed in claim 1, wherein the cutting punches and cutting elements are provided on both edges of each of the wheels.

4. Apparatus according to claim 1, wherein the cutting elements are secured by screws to a recessed flange upon a lateral edge of said one wheel.

5. Apparatus according to claim 1, wherein each cutting element has a radius matched to that of said one wheel.

6. Apparatus according to claim 1, wherein the limbs of each bridge-shaped member of each cutting element form teeth with which the cutting punches cooperate.

* * * * *